US005962935A

United States Patent [19]

Geisert

[11] Patent Number: 5,962,935

[45] Date of Patent: Oct. 5, 1999

[54] APPLIANCE PROTECTION LATCH

[76] Inventor: Harold J. Geisert, 7365 Hopkins Rd., Mentor, Ohio 44060

[21] Appl. No.: 08/985,407

[22] Filed: Dec. 4, 1997

[51] Int. Cl.[6] ..... H01H 35/00

[52] U.S. Cl. ..... 307/126; 361/93

[58] Field of Search ..... 307/126; 361/18, 361/88, 93, 111, 160; 340/635, 644, 657, 659

[56] References Cited

U.S. PATENT DOCUMENTS

| | | | |
|---|---|---|---|
| 4,331,996 | 5/1982 | Matsko et al. | 361/92 |
| 4,568,997 | 2/1986 | Bienwald et al. | 361/45 |
| 4,584,623 | 4/1986 | Bello et al. | 361/90 |
| 4,705,342 | 11/1987 | Schwartz | 439/650 |
| 4,712,154 | 12/1987 | Madsen | 361/178 |
| 4,853,821 | 8/1989 | Lewis | 361/92 |
| 4,918,562 | 4/1990 | Pulizzi et al. | 361/86 |
| 5,731,942 | 3/1998 | Raviele | 361/75 |

*Primary Examiner*—Richard T. Elms
*Assistant Examiner*—Peter Zura

[57] ABSTRACT

An electric appliance protection apparatus is provided including a housing having a socket formed therein in coplanar relationship therewith. The socket is provided for removably receiving a plug of an appliance. A plurality of prongs are mounted on the housing which define a plug for being removably inserted within a conventional alternating current receptacle. Three wires are situated within the interior space of the housing and connected between the socket and the prongs thereof. The wires include a hot wire, a neutral line, and a ground line. Finally, a control mechanism has a deactuated mode wherein power transfer between the socket and prongs of the housing is precluded and an actuated mode wherein power transfer between the socket and prongs of the housing is permitted only upon the depression of momentary switch while power is available from the conventional power source. It should be noted that the control mechanism remains in the actuated mode only during the continued receipt of power from the conventional power source.

2 Claims, 2 Drawing Sheets

APPLIANCE PROTECTION LATCH

BACKGROUND OF THE INVENTION

1. Field of the Invention

The present invention relates to voltage clamping protection circuits and more particularly pertains to a new appliance protection latch for precluding augmented electric transients from damaging an appliance.

2. Description of the Prior Art

The use of voltage clamping protection circuits is known in the prior art. More specifically, voltage clamping protection circuits heretofore devised and utilized are known to consist basically of familiar, expected and obvious structural configurations, notwithstanding the myriad of designs encompassed by the crowded prior art which have been developed for the fulfillment of countless objectives and requirements.

Known prior art voltage clamping protection circuits include U.S. Pat. No. 4,331,996; U.S. Pat. No. 4,584,623; U.S. Pat. No. 4,918,562; U.S. Pat. No. 4,725,697; U.S. Pat. No. 4,705,342; and U.S. Pat. Des. No. 304,324.

In these respects, the appliance protection latch according to the present invention substantially departs from the conventional concepts and designs of the prior art, and in so doing provides an apparatus primarily developed for the purpose of precluding augmented electric transients from damaging an appliance.

SUMMARY OF THE INVENTION

In view of the foregoing disadvantages inherent in the known types of voltage clamping protection circuits now present in the prior art, the present invention provides a new appliance protection latch construction wherein the same can be utilized for precluding augmented electric transients from damaging an appliance.

The general purpose of the present invention, which will be described subsequently in greater detail, is to provide a new appliance protection latch apparatus and method which has many of the advantages of the voltage clamping protection circuits mentioned heretofore and many novel features that result in a new appliance protection latch which is not anticipated, rendered obvious, suggested, or even implied by any of the prior art voltage clamping protection circuits, either alone or in any combination thereof.

To attain this, the present invention generally comprises a housing including a generally oval outboard face, a generally oval inboard face, and a periphery formed therebetween defining an interior space. The outboard face has a socket formed therein in coplanar relationship therewith for removably receiving a plug of an appliance. The inboard face has a plurality of prongs mounted thereon which define a plug for being removably inserted within a conventional alternating current receptacle. As shown in FIG. 1, three wires are situated within the interior space of the housing. Such wires are connected between the socket and the prongs thereof. The wires include a hot wire, a neutral line, and a ground line. With continuing reference to FIG. 1, a three pole single throw relay is shown which includes two normally open switches. Such switches are each connected along an associated one of the hot and neutral lines. The relay further includes a coil connected to the neutral line for closing the switches of the relay only upon the receipt of power. Associated therewith is a third normally open switch connected between the hot line and the coil for continuing the supply of power to the coil upon at least the instantaneous receipt thereof. Situated on a top planar face of the housing is a momentary switch electrically connected in parallel with the third normally open switch of the relay. As such, the momentary switch allows the passage of an instantaneous supply of power to the coil upon the depression thereof while the prongs of the housing are connected to a live alternating current receptacle. Finally, a toggle switch is situated on a top planar face of the housing. The toggle switch is electrically connected in series with the third normally open switch of the relay. During use, the toggle switch is equipped with a first orientation for allowing the supply of power to the coil and a second orientation for precluding the supply of power to the coil.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new appliance protection latch apparatus and method which has many of the advantages of the voltage clamping protection circuits mentioned heretofore and many novel features that result in a new appliance protection latch which is not anticipated, rendered obvious, suggested, or even implied by any of the prior art voltage clamping protection circuits, either alone or in any combination thereof.

It is another object of the present invention to provide a new appliance protection latch which may be easily and efficiently manufactured and marketed.

It is a further object of the present invention to provide a new appliance protection latch which is of a durable and reliable construction.

An even further object of the present invention is to provide a new appliance protection latch which is susceptible of a low cost of manufacture with regard to both materials and labor, and which accordingly is then susceptible of low prices of sale to the consuming public, thereby making such appliance protection latch economically available to the buying public.

Still yet another object of the present invention is to provide a new appliance protection latch which provides in the apparatuses and methods of the prior art some of the advantages thereof, while simultaneously overcoming some of the disadvantages normally associated therewith.

Still another object of the present invention is to provide a new appliance protection latch for completely precluding augmented electric transients from damaging an appliance.

Even still another object of the present invention is to provide a new appliance protection latch that includes a housing having a socket formed therein in coplanar relationship therewith. The socket is provided for removably receiving a plug of an appliance. A plurality of prongs are mounted on the housing which define a plug for being removably inserted within a conventional alternating current receptacle. Three wires are situated within the interior space of the housing and connected between the socket and the prongs thereof. The wires include a hot wire, a neutral line, and a ground line. Finally, a control mechanism has a deactuated mode wherein power transfer between the socket and prongs of the housing is precluded and an actuated mode wherein power transfer between the socket and prongs of the housing is permitted only upon the depression of momentary switch while power is available from the conventional power source. It should be noted that the control mechanism remains in the actuated mode only during the continued receipt of power from the conventional power source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
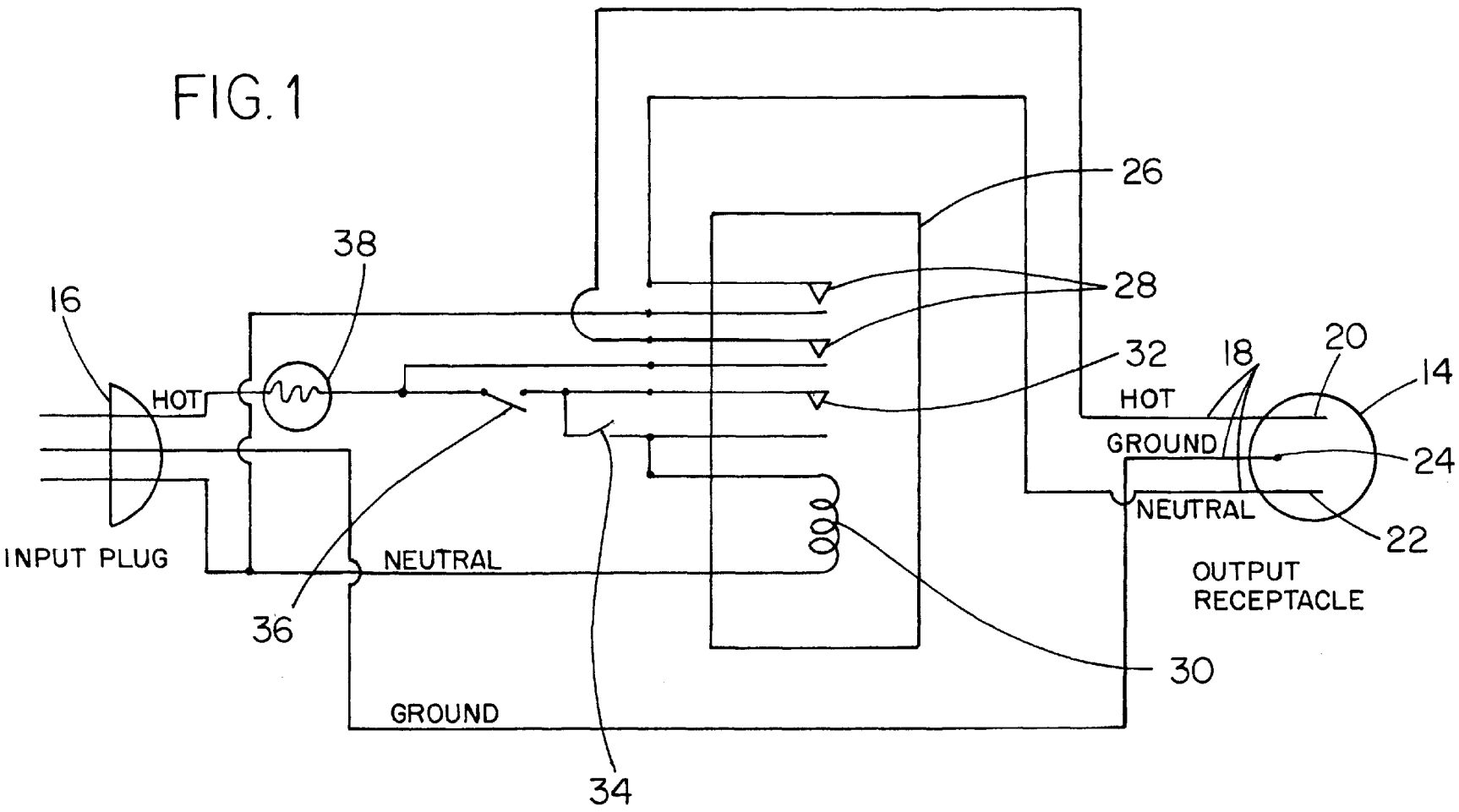
FIG. 1 is a schematic diagram of a new appliance protection latch according to the present invention.
Figure 2:
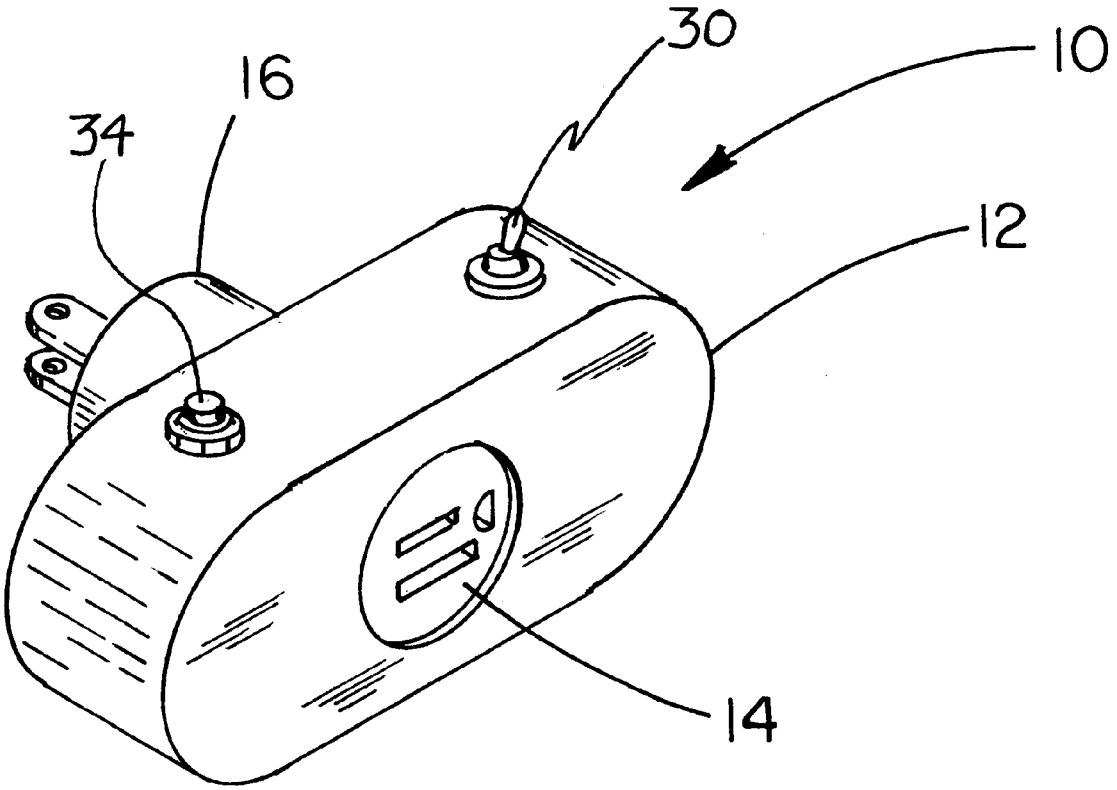
FIG. 2 is a perspective view of the present invention.

With reference now to the drawings, and in particular to FIGS. 1 through 2 thereof, a new appliance protection latch embodying the principles and concepts of the present invention and generally designated by the reference numeral 10 will be described.

The present invention, designated as numeral 10, includes a housing 12 including a generally oval outboard face, a generally oval inboard face, and a periphery formed therebetween defining an interior space. The outboard face has a socket 14 formed therein in coplanar relationship therewith for removably receiving a plug 16 of an appliance. The inboard face has a plurality of prongs mounted thereon which define a plug for being removably inserted within a conventional alternating current receptacle.

As shown in FIG. 1, three wires 18 are situated within the interior space of the housing. Such wires are connected between the socket and the prongs of the housing. The wires include a hot wire 20, a neutral line 22, and a ground line 24.

With continuing reference to FIG. 1, a three pole single throw relay 26 is shown which includes two normally open switches 28. Such switches are each connected along an associated one of the hot and neutral lines. The relay further includes a coil 30 connected to the neutral line for closing the switches of the relay only upon the receipt of power. Associated therewith is a third normally open switch 32 connected between the hot line and the coil for continuing the supply of power to the coil upon at least the instantaneous receipt thereof.

Situated on a top planar face of the housing is a momentary switch 34 electrically connected in parallel with the third normally open switch of the relay. As such, the momentary switch allows the passage of an instantaneous supply of power to the coil upon the depression thereof while the prongs of the housing are connected to a live alternating current receptacle.

Finally, a toggle switch 36 is situated on a top planar face of the housing beside the momentary switch. The toggle switch is electrically connected in series with the parallel combination of the momentary switch and the third normally open switch of the relay. During use, the toggle switch is equipped with a first orientation for allowing the supply of power to the coil and a second orientation for precluding the supply of power to the coil. As an option, a fuse 38 may be connected in series with the toggle switch and momentary switch for protection purposes.

During use, the prongs and socket of the housing are first plugged into the conventional current receptacle and appliance, respectively. Thereafter, the momentary switch is depressed to supply current to the appliance. It is imperative that the momentary switch be depressed only after the prongs are plugged into the receptacle. This ensures that any augmented transient is completely precluded from being applied to the appliance. At any time, the toggle switch may be employed to actuate and deactuate the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self-contained electric appliance protection apparatus mountable on a conventional wall-mounted electrical power outlet, the apparatus comprising, in combination:

a housing including an outboard face on the housing, an inboard face on the housing, and a periphery formed between the inboard and outboard faces to define an interior space of the housing, the outboard face of the housing having a socket integrally formed therein for removably receiving a plug of an appliance, the inboard face of the housing having a plurality of prongs mounted thereon which define a plug for being removably inserted into a conventional wall-mounted electrical power outlet such that the housing is entirely supportable on a wall by the power outlet;

three wires entirely situated within the interior space of the housing and connected between the socket on the outboard face of the housing and the prongs on the inboard face of the housing, the wires including a hot wire, a neutral line, and a ground line;

a three pole single throw relay positioned in the interior space of the housing, the relay including two normally open switches including a first normally open switch connected along the hot line and a second normally open switch connected along the neutral line, the relay further including a coil connected to the neutral line for closing the switches of the relay only upon the receipt of power and a third normally open switch connected between the hot line and the coil for continuing the supply of power to the coil upon the receipt of power by the coil and for the duration of the receipt of power by the coil;

a momentary switch situated on the housing and being electrically connected in parallel with the third normally open switch of the relay for allowing the passage of power to the coil upon the depression of the momentary switch while the prongs of the housing are connected to a live electrical power outlet; and a manually operated toggle switch situated on the housing and being electrically connected in series with the third normally open switch of the relay with a first orientation for allowing the supply of power to the coil and a second orientation for precluding the supply of power to the coil.

2. The electric appliance protection apparatus as set forth in claim 1 wherein the housing includes a generally oval outboard face, and a generally oval inboard face.

* * * * *